US009431204B2

(12) United States Patent
Johann et al.

(10) Patent No.: US 9,431,204 B2
(45) Date of Patent: Aug. 30, 2016

(54) LIGHT SOURCE WITH GAS DISCHARGE LAMP

(75) Inventors: Christian Johann, Reutlingen (DE); Lars Dabringhausen, Aachen (DE); Thomas Jaiser, Kirchentellinsfurt (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 954 days.

(21) Appl. No.: 12/975,993

(22) Filed: Dec. 22, 2010

(65) Prior Publication Data

US 2011/0148299 A1 Jun. 23, 2011

(30) Foreign Application Priority Data

Dec. 22, 2009 (DE) ..... 10 2009 060 778
May 7, 2010 (DE) ..... 10 2010 019 679

(51) Int. Cl.

| | |
|---|---|
| ***F21V 15/02*** | (2006.01) |
| ***H01J 5/48*** | (2006.01) |
| ***H01J 5/50*** | (2006.01) |
| *F21V 13/02* | (2006.01) |
| *F21Y 103/00* | (2016.01) |
| *F21S 8/10* | (2006.01) |

(52) U.S. Cl.

CPC .. *H01J 5/48* (2013.01); *H01J 5/50* (2013.01); *F21S 48/1186* (2013.01); *F21V 13/02* (2013.01); *F21Y 2103/00* (2013.01)

(58) Field of Classification Search

CPC ..... F21Y 2103/00
USPC ..... 315/45–75, 94–107, 112–118; 362/194, 362/222, 223, 226, 296, 300, 303, 307, 310, 362/311, 362, 378

See application file for complete search history.

(56) References Cited

U.S. PATENT DOCUMENTS

| | | | | |
|---|---|---|---|---|
| 5,073,845 | A * | 12/1991 | Aubrey | 362/650 |
| 5,793,456 | A * | 8/1998 | Broer et al. | 349/98 |
| 5,923,127 | A | 7/1999 | Keijser et al. | |
| 6,177,678 | B1 * | 1/2001 | Brass et al. | 250/461.1 |
| 8,436,711 | B2 * | 5/2013 | Rohl et al. | 336/221 |
| 8,653,727 | B2 * | 2/2014 | Li et al. | 313/323 |
| 2003/0222558 | A1 * | 12/2003 | Cok | 313/238 |

(Continued)

FOREIGN PATENT DOCUMENTS

| | | |
|---|---|---|
| CN | 101324311 A | 12/2008 |
| DE | 848742 | 9/1952 |

(Continued)

OTHER PUBLICATIONS

May 19, 2011 European Examination Report for Application No. 10014656.2-2206.

(Continued)

*Primary Examiner* — Tuyet Vo
(74) *Attorney, Agent, or Firm* — Howard & Howard Attorneys PLLC

(57) ABSTRACT

A light source (7) with a gas-discharge lamp includes a control module (16) with a driver circuit, an ignition module (17) for producing a substantially high voltage, and a gas-filled burner (18) in which an electric arc is ignited and maintained between two electrodes (19, 20). The control module (16), ignition module (17), and burner (18) are attached to a mutual support system (21) and combined in a single unit. Lighting equipment (1) for a motor vehicle includes at least one light source (7).

7 Claims, 3 Drawing Sheets

(56) References Cited

U.S. PATENT DOCUMENTS

| | | | | |
|---|---|---|---|---|
| 2005/0259419 | A1* | 11/2005 | Sandoval | 362/249 |
| 2008/0062703 | A1* | 3/2008 | Cao | 362/311 |
| 2008/0123345 | A1* | 5/2008 | Hamada | F21S 48/1109 362/310 |
| 2008/0165538 | A1* | 7/2008 | Callahan | 362/296 |
| 2008/0309240 | A1* | 12/2008 | Goray et al. | 315/56 |
| 2009/0134762 | A1* | 5/2009 | Serita et al. | 313/113 |
| 2010/0027284 | A1* | 2/2010 | Ackermann | F21S 48/1154 362/516 |
| 2010/0079055 | A1* | 4/2010 | Roberts et al. | 313/485 |
| 2010/0328466 | A1* | 12/2010 | Erel et al. | 348/164 |
| 2011/0234096 | A1* | 9/2011 | Asmussen et al. | 315/53 |
| 2012/0056539 | A1* | 3/2012 | Deguchi et al. | 315/77 |

FOREIGN PATENT DOCUMENTS

| | | | |
|---|---|---|---|
| DE | 102 21 160 | A1 | 11/2002 |
| DE | 10 2008 062 675 | A1 | 7/2010 |
| EP | 0 855 851 | A2 | 7/1998 |
| EP | 1 273 848 | A1 | 1/2003 |

OTHER PUBLICATIONS

Jan. 23, 2012 official action from the German Patent Office for Application No. 10 2010 019 679.7.

CN Application 201010614728.5—Office Action dated Apr. 28, 2014.

* cited by examiner

LIGHT SOURCE WITH GAS DISCHARGE LAMP

CROSS-REFERENCE TO RELATED APPLICATION

This application claims priority to and benefit of the filing date of German Patent Application 10 2009 060 778.1 filed on Dec. 22, 2009 and German Patent Application 10 2010 019 679.7 filed on May 7, 2010 and entitled "Light Source with a Gas Discharge Lamp and Lighting Equipment for a Motor Vehicle Having Such a Light Source."

BACKGROUND OF INVENTION

1. Field of Invention

The invention relates, generally, to lighting equipment for a motor vehicle and, more specifically, to a light source with a gas-discharge lamp employed with such lighting equipment.

2. Description of Related Art

A light source of the related art is known from, for example, "WO 2004/083900A1" or "WO 2004/084250A1." In one of the gas-discharge lamps described there, inert gas or a gas mixture is contained in a burner, which can also be described as a "discharge vessel" or "inner bulb." Voltage is applied between two electrodes extending into the interior of the burner, forming an electric arc between the electrodes, which results in light emission. The electric arc can be maintained while the light source is operating. In the process, a driver circuit of a control module or a control unit of the gas-discharge lamp generates from the 12- or 24-V-battery charge an intermediate voltage of several hundred volts up to more than 1,000 V—for example, approximately 1,200 V—that are applied between the two potentials of −700 and +500 V. From this intermediate voltage, an ignition module of the gas-discharge lamp generates an ignition voltage (high voltage) for the burner, which can amount to several kilovolts—for example, in the range of between 10 and 25 kV (specifically, 23 kV). To ignite the electric arc, the ignition voltage is applied to the electrodes. When the electric arc has been ignited, the voltage that is applied at the electrodes can be reduced to a supply voltage (AC voltage) of merely several volts—for example, 43 or 85 V at 400 Hz. The supply voltage is supplied by a driver circuit of the control module. The ignition voltage can be generated by stepping up the supply voltage.

The known light sources have a separate control module that is arranged spatially separated from the burner. The ignition module is integrated in the control module or arranged directly at the burner and/or a socket of the gas-discharge lamp. The supply voltage generated by the control module is guided to the burner or ignition module via a shielded conduit and applied to the electrodes. In the known gas-discharge lamps, the control module is decentralized for thermic reasons. For example, the driver circuit designed in the control module includes several electronic components that generate, for the most part, a considerable quantity of heat during the time of operating the light source. This heat can be easily discharged at a distance from the burner where the ambient temperatures are not so high. The electric arc that is ignited and maintained inside the burner generates extremely high temperatures that can amount to several-hundred degrees Celsius and can reach 1,000° C. and more. These high temperatures would adversely affect or even damage the driver circuit or its electronic components if the control module was arranged in close proximity of the burner.

However, the known light sources have the disadvantage that they require a relatively large space because the control module is arranged separately from the remaining part of the light source. Moreover, the shielded connecting cable required between the control module and remaining part of the light source (the burner or ignition module) results in additional costs and an increase in expenses during assembly. Because of the AC signals transmitted via the connecting cable and the resulting electromagnetic radiation, it is required that the connecting cable be well-shielded against electromagnetic radiation. This is achieved by, for example, surrounding the connecting cable with a metal mesh or metal/plastic mesh. However, this mesh has to fulfill a number of requirements that, in turn, results in relatively high costs for the shielded connecting cable. For example, if the light source is part of a movable light module, the mesh has to be flexible enough such that the shielded connecting cable does not adversely or significantly affect a movement of the burner in relation to the control module. Otherwise, a reliable movement, especially a steady movement, of the light module cannot be guaranteed, or it requires especially strong forces and especially large and heavy drive units.

Thus, there is a need in the related art for a light source including a gas-discharge lamp that is compact, easy to use, and cost-effective.

SUMMARY OF INVENTION

The invention overcomes the disadvantages in the related art in a light source with a gas-discharge lamp. The light source includes a control module with a driver circuit, an ignition module for producing a substantially high voltage, and a gas-filled burner in which an electric arc is ignited and maintained between two electrodes. The control module, ignition module, and burner are attached to a mutual support system and combined in a single unit. The invention overcomes the disadvantages in the related art also in lighting equipment for a motor vehicle that includes at least one light source.

One advantage of the light source with a gas-discharge lamp of the invention is that it is compact, easy to use, and cost-effective.

Another advantage of the light source with a gas-discharge lamp of the invention is that the heat generation during operation is lower than in customary gas-discharge lamps previously used in lighting equipment of motor vehicles.

Another advantage of the light source with a gas-discharge lamp of the invention is that the gas-discharge lamp can have an electrical power that is between twenty and thirty percent lower than the electrical power of customary gas-discharge lamps.

Another advantage of the light source with a gas-discharge lamp of the invention is that, assuming that customary gas-discharge lamps have a power of approximately thirty-five watts, the gas-discharge lamp has a power of, for example, approximately twenty-five watts.

Another advantage of the light source with a gas-discharge lamp of the invention is that the reduced power results in lower temperatures of the electric arc, considerably less heat, as well as a reduction of the power loss of the control module.

Another advantage of the light source with a gas-discharge lamp of the invention is that the reduced lighting current resulting from the reduced power does not inevitably result in poorer illumination of the road or other areas in front of the motor vehicle.

Another advantage of the light source with a gas-discharge lamp of the invention is that it is possible, by optimizing the remaining components of the lighting equipment of the motor vehicle provided with the power-reduced gas-discharge lamp, to achieve an illumination comparable to the more-powerful customary gas-discharge lamps.

Another advantage of the light source with a gas-discharge lamp of the invention is that the reduced power of the gas-discharge lamp results in, during operation, the gas-discharge lamp generating considerably less heat than customary gas-discharge lamps.

Another advantage of the light source with a gas-discharge lamp of the invention is that it is possible to attach the control module in the proximity of the burner at a mutual support system without restricting the functions of or even damaging the control module or its driver circuit or any of the electronic components.

Another advantage of the light source with a gas-discharge lamp of the invention is that it is not required to arrange in the motor vehicle for a separate control module detached from the remaining parts of the gas-discharge lamp—for example, in the form of a control unit that has its own housing.

Another advantage of the light source with a gas-discharge lamp of the invention is that combining the control module, ignition module, and burner in a single unit eliminates the need for connecting cables between the control module and burner or ignition module.

Another advantage of the light source with a gas-discharge lamp of the invention is that it is possible to operate the light source separately as an individual unit, which considerably facilitates the shipping and assembly of the light source in the lighting equipment of the invention for a motor vehicle.

Another advantage of the light source with a gas-discharge lamp of the invention is that the individual modules of the light source—i.e., control module, ignition module, and burner—can be manufactured as separate modules and tested individually.

Another advantage of the light source with a gas-discharge lamp of the invention is that it is possible, for example, to combine different modules for different light sources for different purposes and customer wishes without having to develop in each case a completely new light source.

Another advantage of the light source with a gas-discharge lamp of the invention is that a new light source can be assembled with reliable individually tested modules such that development time and costs can be considerably reduced.

Another advantage of the light source with a gas-discharge lamp of the invention is that (besides the function of connecting the individual components of the light source) the housing can provide heat emission (heat dissipation or cooling) as well as EMC shielding and protection against moisture, dirt, and mechanical wear.

Another advantage of the light source with a gas-discharge lamp of the invention is that the surface of the housing has a high emission ratio [an indicator of how much radiation is emitted in comparison to an ideal heat radiator (a so-called "black body")] of, for example, greater than about 0.7—in particular, greater than about 0.9.

Another advantage of the light source with a gas-discharge lamp of the invention is that modules of the light source in the upper area of the support system are able to tolerate high temperatures without suffering functional impairment or damage.

Other objects, features, and advantages of the invention will be readily appreciated as the same becomes better understood while reading the subsequent description taken in conjunction with the accompanying drawings.

BRIEF DESCRIPTION OF EACH FIGURE OF DRAWING OF INVENTION

DETAILED DESCRIPTION OF EMBODIMENTS OF INVENTION

Figure 1:
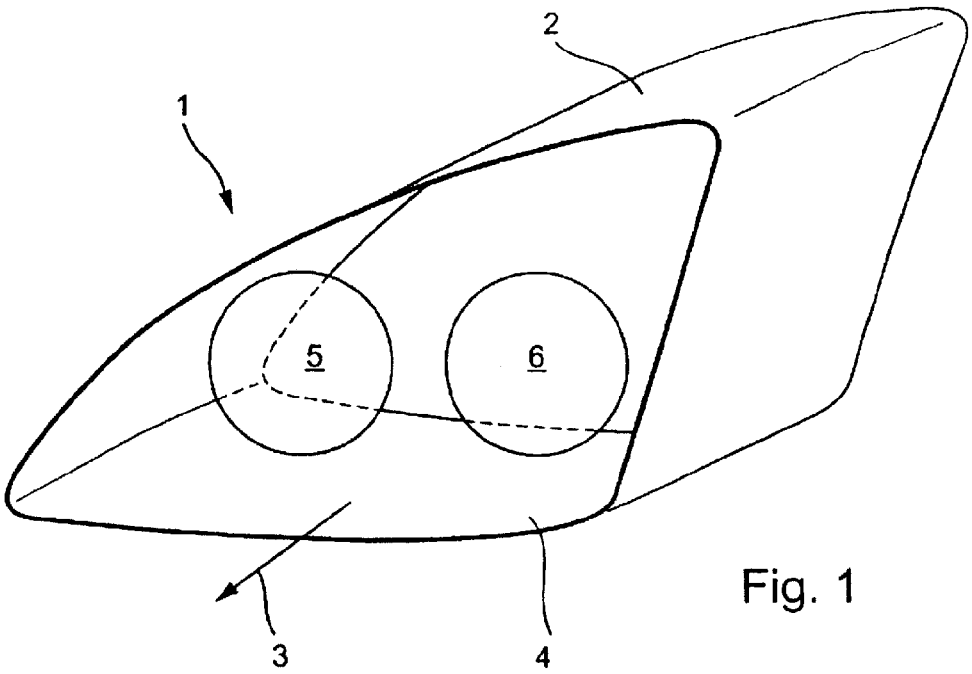
FIG. 1 is a perspective view showing lighting equipment for a motor vehicle having a light source according to an embodiment of the invention.

In FIG. 1, an embodiment of lighting equipment according to the invention for motor vehicles is generally indicated at 1 as a whole. In the embodiment, the lighting equipment 1 is designed as a motor-vehicle headlight. The lighting equipment 1 can certainly also be designed as a light fixture or the like. The headlight 1 includes a housing 2, which can be constructed of plastic. In a "light exit" direction 3, the headlight housing 2 has a light-exit opening that is closed by a transparent covering disc 4. The covering disc 4 is manufactured from transparent plastic or glass. The covering disc 4 can be designed as a so-called "clear disc" without optically effective profiles (for example, prisms). Alternatively, the covering disc 4 can be provided with optically effective profiles (at least in some areas).

The figure of the embodiment shows two light modules, generally indicated at 5, 6, that are arranged inside the headlight housing 2. The light modules 5, 6 are affixed to the housing 2 or arranged such that they can be moved relative to the housing 2. The light modules 5, 6 are designed to generate a desired light distribution—for example, a/an low-beam-, high-beam-, city-, country-, motorway-, fog-, static- or dynamic-curve-, or any other static- and/or adaptive-light distribution. The light modules 5, 6 generate the desired lighting function individually or in combination with each other in that the partial light distributions supplied by each individual light module 5, 6 are overlapping to produce the desired light distribution. The light modules 5, 6 can be designed as a "reflection" module and/or "projection" module. It is also possible to provide the headlight housing 2 with more or fewer light modules 5, 6.

Figure 2:
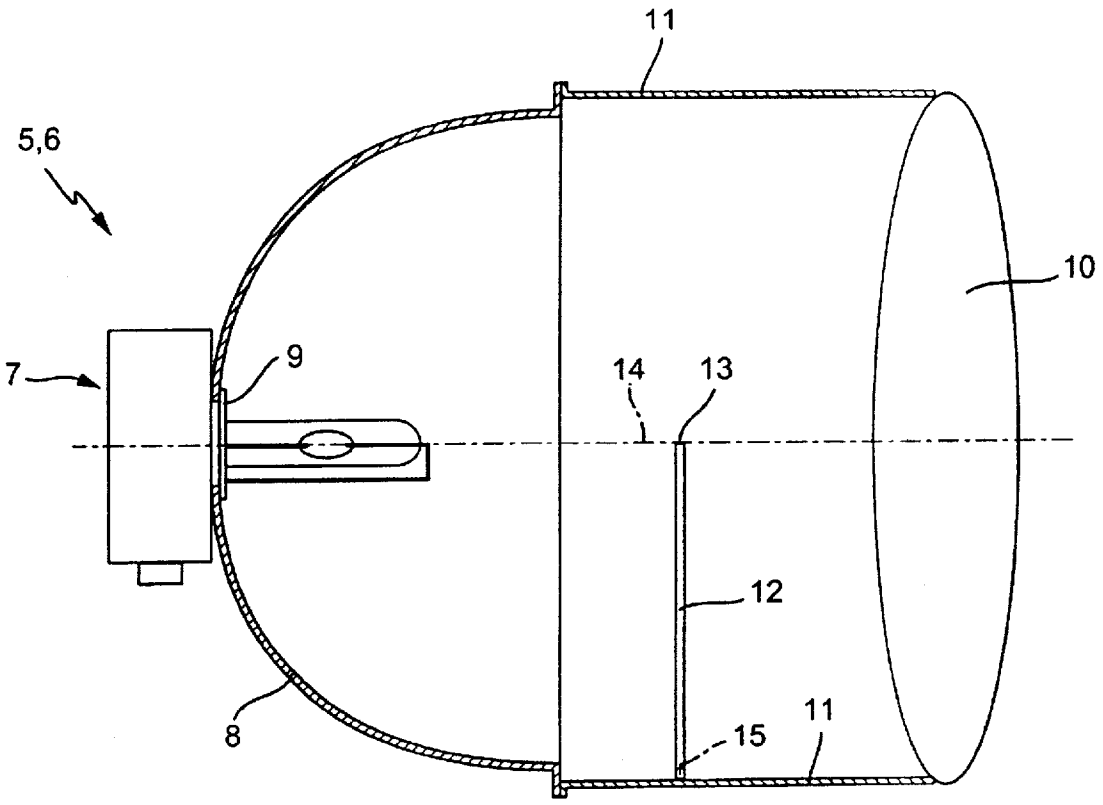
FIG. 2 is a view showing a light module of the embodiment of the lighting equipment illustrated in FIG. 1.

FIG. 2 shows an embodiment of a light module 5, 6 designed as a "projection" module. It includes a light source, generally indicated at 7, that emits the electromagnetic radiation, such as light that is visible to the human eye. In addition, the light module 5, 6 includes primary optics 8 in the form of a reflector 7 for concentrating the emitted light. From the rear side of the reflector 8, the light source 7 is inserted into a receiving opening at the apex of the reflector 8 and mounted there in, for example, bayonet fashion. The light source 7 is provided with a lamp socket to be able to attach the light source 7 to the reflector 8.

The light emitted by the light source 7 and concentrated by the reflector 8 is displayed on the road in front of the motor vehicle by secondary optics 10 that is designed as, for example, a projection lens. The lens 10 is attached at the front edge of the reflector 8 by a lens holder 11. If the light distribution to be generated by the light module 5, 6 has a horizontal light/dark boundary (for example, in case of a low-beam- or fog-beam-light distribution), a screen arrangement 12 is provided between the primary optics 8 and secondary optics 10, and the projection lens 10 projects an upper edge 13 of the screen arrangement 12 as a light/dark boundary on the road in front of the motor vehicle. The progression of the upper edge 13 of the screen arrangement 12 can be varied for generating a variable or an adaptive light distribution. It is also possible that the screen arrangement 12 as a whole can be swiveled about a rotational axis 15 that runs at a distance and transverse to an optical axis 14 of the light module 5, 6. In this way, the screen 12 can be moved into and out of the optical path, and the light distribution emitted from the light module 5, 6 can be switched between a dimmed light distribution (for example, low-beam light) and non-dimmed light distribution (for example, high-beam light).

Figure 3:
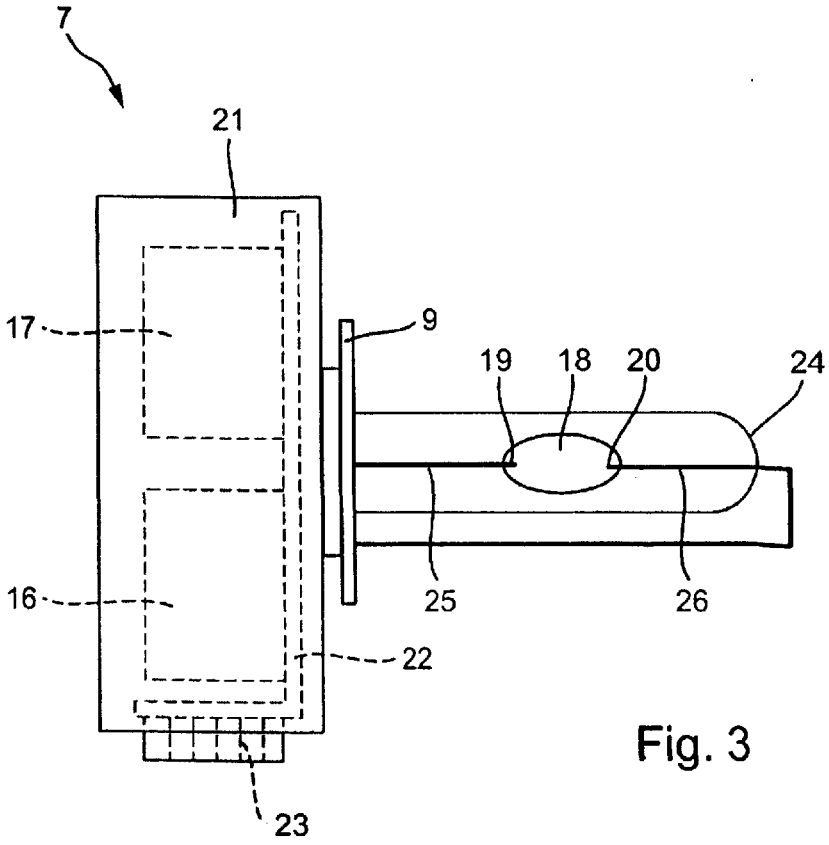
FIG. 3 is a view showing a light source of the embodiment of the light module illustrated in FIG. 2 or the light source of the embodiment of the lighting equipment illustrated in FIG. 1.

FIG. 3 shows an embodiment of the light source 7 used in the light module 5, 6. The light source 7 includes a gas-discharge lamp as well as a control module 16 with a driver circuit for generating an intermediate voltage or a supply voltage for the gas-discharge lamp, an ignition module 17 for generating high voltage (ignition voltage) from the intermediate voltage, and a gas-filled burner 18. The burner 18 is filled with an inert gas or a gas mixture. Two electrodes 19, 20 extend into the burner 18. For operating the light source 7, an electric arc is ignited between the electrodes 19, 20 and maintained during the operation of the light source 7. The burner 18 (a so-called "internal bulb") is arranged inside an air-filled bulb 24 (a so-called "external bulb"). The burner 18 and bulb 24 include quartz glass. Supply lines 25, 26 extend through the bulb 24, and the ignition voltage or supply voltage is applied to the electrodes 19, 20 by the supply lines 25, 26. The supply lines 25, 26 are guided through a socket 9 and into the interior of a housing 21, and there they are connected to the control module 16 and/or ignition module 17.

In the light source 7, the control module 16, ignition module 17, and burner 18 are attached to a mutual support system 21 and combined into a single unit. Besides providing an attachment for the individual components, the support system 21 can also function as a housing for the electrical circuits of the control module 16 and ignition module 17. It can also be used to function as a cooling element by which the heat of the electronic components of the control module 16 and/or ignition module 17 is emitted. The housing 21 protects the circuits or electronic components of the control module 16 and ignition module 17 against dirt, moisture, and mechanical damage. Moreover, the housing 21 is used as an EMC shield so that electronic disturbances from the outside do not affect the circuits or electronic components of the control module 16 and ignition module 17 and electromagnetic disturbances of the circuits or electronic components of the control module 16 and ignition module 17 do not affect circuits and components located outside of the housing 21.

The electronic components of the circuits of the control module 16 and ignition module 17 are arranged on at least one conductor board 22, mechanically attached, and electrically contacted. Via conducting paths designed on the conductor board 22, the two modules 16, 17 are electrically connected with each other as well as with other components for energy supply and/or signal transmission. The remaining components involve, for example, a connector or socket element 23, which is designed at the bottom of the conductor board 22 and extends to the outside by a hole in the housing 21. A respective socket or connector element (not shown) can be connected with a trunk line to the connector or socket element 23. By the socket or connector element, the light source 7 or control module 16 and ignition module 17 can be connected to a primary control unit—for example, a so-called "body controller"—or, for energy supply, with a power supply—for example, a motor-vehicle battery.

Again, it is possible in the light source 7 to position the control module 16 in close proximity to the burner 18 without causing thermal problems or overheating the electronic components of the control module 16. This is possible because the lamp power of the burner 18 is lower compared to that of customary gas-discharge lamps. The high packing density of the light source 7 is possible because, with the reduced power of the light source 7, the thermal management can be controlled even from economic aspects. The different individual components of the light source 7—i.e., the control module 16, ignition module 17, and burner 18—can be manufactured and tested as separate modules. In the final production process, all required modules are mounted in the mutual support system 21. From a thermal point of view, it is advantageous to mount modules that can tolerate high temperatures—for example, the ignition module 17—in the upper part of the support system 21. Modules that are not so temperature-resistant—for example, the control module 16 or connector or socket element 23—are mounted in the bottom part of the support system 21. The light source 7 allows for an especially compact structure of a gas-discharge lamp. Because of the small structure, it is advisable for cooling purposes to take suitable measures for increasing the radiated thermal energy. To this end, it is possible to provide the surface of the housing 21 with a particularly high emission ratio (for example, 0.9). For example, the particularly high emission ration can be achieved by finishing the housing 21 with a suitable varnish. In infrared ranges, the varnish has to act like a blackbody.

The invention been described in an illustrative manner. It is to be understood that the terminology that has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A motor vehicle illumination device (1) comprising:

A housing (2) having at least one light module (5, 6) operatively supported in said housing, said at least one light module (5, 6) including a single light source (7) and a reflector (8) for concentrating light emitted by said light source (7), said reflector (8) defining an apex at one end of said reflector and having an opening extending through said apex of said reflector;

said light source (7) including a lamp housing (21) having a lamp socket (9) and a control module (16) with a driver circuit and an ignition module (17) operatively supported in said lamp housing (21), said ignition module (17) for producing a high voltage;

said light source (7) further including a gas filled burner (18) having two electrodes (19, 20) supported therein and generating an electric arc between the electrodes (19, 20) during operation of said light source (7), said gas filled burner (18) being operatively attached to said lamp housing (21) via said lamp socket (9) and wherein said lamp housing (21), said control module (16), said ignition module (17), and said gas filled burner (18) form a single integrated unit light source (7); and said gas filled burner (18) extending through said opening in said reflector (8) and said lamp socket (9) being operatively mounted in bayonet fashion directly to said reflector (8) such that said gas filled burner (18) may be removed and replaced.

2. A light source as set forth in claim 1, wherein said lamp housing is metal.

3. A light source as set forth in claim 1, wherein said lamp housing is adapted to increase emission of heat to an area surrounding said housing.

4. A light source as set forth in claim 1, wherein a surface of said lamp housing has an emission ratio of greater than about 0.7.

5. A light source as set forth in claim 1, wherein said ignition module is arranged at said lamp housing above at least one of said control module and burner in an operating position of said light source.

6. A light source as set forth in claim 4, wherein said emission ratio is greater than about 0.9.

7. A light source as set forth in claim 4, wherein said surface of said housing is finished with a varnish.

* * * * *